US007360629B2

(12) United States Patent
Hagi et al.

(10) Patent No.: US 7,360,629 B2
(45) Date of Patent: Apr. 22, 2008

(54) ZONALLY OPERATED ELEVATOR INSTALLATION AND METHOD

(75) Inventors: Eugen Hagi, Adligenswil (CH); Miroslav Kostka, Ballwil (CH)

(73) Assignee: Inventio AG, Hergiswil (CH)

( * ) Notice: Subject to any disclaimer, the term of this patent is extended or adjusted under 35 U.S.C. 154(b) by 608 days.

(21) Appl. No.: 10/950,899

(22) Filed: Sep. 27, 2004

(65) Prior Publication Data

US 2005/0087402 A1 Apr. 28, 2005

(30) Foreign Application Priority Data

Oct. 9, 2003 (EP) ..... 03405726

(51) Int. Cl.
*B66B 9/00* (2006.01)

(52) U.S. Cl. ..... 187/249; 187/383

(58) Field of Classification Search ..... 187/247, 187/248, 249, 380–389, 414, 902
See application file for complete search history.

(56) References Cited

U.S. PATENT DOCUMENTS

| | | | | |
|---|---|---|---|---|
| 4,632,224 | A | 12/1986 | Nowak et al. | |
| 5,419,414 | A | 5/1995 | Sakita | |
| 5,749,441 | A * | 5/1998 | Bittar et al. | 187/249 |
| 5,823,299 | A * | 10/1998 | Wierschke et al. | 187/277 |
| 5,924,524 | A * | 7/1999 | Barker et al. | 187/249 |
| 6,871,727 | B2 * | 3/2005 | Jokela et al. | 187/383 |
| 2005/0077115 | A1 * | 4/2005 | Urata | 187/383 |
| 2006/0016640 | A1 * | 1/2006 | Duenser et al. | 187/249 |
| 2007/0039785 | A1 * | 2/2007 | Smith et al. | 187/383 |

FOREIGN PATENT DOCUMENTS

| | | |
|---|---|---|
| CN | 1162565 A | 10/1997 |
| CN | 1409687 | 4/2003 |
| EP | 0 820 952 A2 | 1/1998 |
| EP | 1329412 | 7/2003 |
| JP | 2000309482 | 11/2000 |
| JP | 2000344430 | 12/2000 |
| WO | WO 01/00519 A1 | 1/2001 |

* cited by examiner

*Primary Examiner*—Jonathan Salata
(74) *Attorney, Agent, or Firm*—Klaus P. Stoffel; Wolff & Samson PC

(57) ABSTRACT

An elevator installation for zonal operation in a building, a method for zonal operation of such an elevator installation and method for modernization of an existing elevator installation, in which the building is divided into several zones. The elevator installation includes several elevators for the transport of persons/goods in cages. A zone is associated each elevator. At least one changeover storey for the changing over of persons/goods between cages of different zones is arranged between the zones. At least one elevator has at least two cages which are arranged one above the other and which are movable independently of one another at a pair of guide rails.

30 Claims, 3 Drawing Sheets

ZONALLY OPERATED ELEVATOR INSTALLATION AND METHOD

BACKGROUND OF THE INVENTION

The invention relates to an elevator installation for zonal operation in a building with several elevators for the transport of persons/goods in cages, wherein the building is divided into zones. A zone is allocated to each elevator and at least one changeover storey for the changing over of persons/goods between cages of different zones is arranged between the zones. The invention also relates to a method for zonal operation of such an elevator installation and it relates to a method for modernization of an elevator installation.

A high transport requirement exists today in large or high buildings. In order to satisfy this transport requirement, a building is frequently vertically divided into several zones or storey regions. At least one elevator or group of elevators is provided in each zone. A changeover of persons/goods from an elevator bringing up to a first zone to an elevator taking away to a second zone takes place between the zones. The changeover storey is also termed sky lobby.

It is disadvantageous that due to unequal transport capacities of the elevators of the different zones, queues can form in the changeover storey when there is a high incidence of transport. In addition, it is disadvantageous that the elevator installations in high buildings demand a significant proportion of the building cross-section. Finally, the space available in the changeover storey is limited and cannot be increased without substantial constructional and financial outlay.

Known solutions for preventing or limiting overfilling of the changeover storey are targeted either towards a reduction in the transport capacity of the elevator bringing up, which has a counterproductive effect with respect to main load times at transport peaks, or towards measures for increasing the transport capacity of the elevator taking away, which in practice can be realized only to a limited extent. Thus, for example, an increase in the speed/acceleration of the cages or a shortening of door opening times is employed. However, elevators are usually not over-dimensioned with respect to motor power and current supply, so that an increase in speed/acceleration of the cages comes into consideration only to a very limited scope. Moreover, an increase in acceleration of the cages has a negative effect on travel sensation of persons, so that here, too, an increase in transport capacity can be achieved only to a very limited extent. In addition, a shortening or optimization of the door opening times is already implemented as standard practice in many elevators. Thus, these measures do not lead to any actually noticeable increase in transport capacity.

SUMMARY OF THE INVENTION

The object of the present invention thus consists in avoiding the above-mentioned disadvantages by creating an elevator installation for zonal operation in a building which enables an increase in the transport capacity of the entire elevator installation without in that case reducing the transport capacity of an elevator arriving or an elevator taking away. The object is also directed to a method for zonal operation of an elevator installation. The object shall be realized by known and proven means of elevator construction.

The invention relates to an elevator installation for zonal operation in a building and to a method for zonal operation of such an elevator installation. The building is divided into several zones. The elevator installation comprises several elevators for the transport of persons/goods in cages. A zone is associated with each elevator. At least one changeover storey for the changing over of persons/goods between cages of different zones is arranged between the zones. At least one elevator comprises two cages which are arranged one above the other and which are movable independently of one another at a pair of guide rails.

According to the invention, an increase in transport capacity of the elevator installation is effected in that at least one elevator has two cages movable independently of one another instead, as usual, of a single cage. The overall number of movable cages of the elevator installation is thereby increased, while the demand of the elevator installation on space in the building cross-section is kept the same. Due to the increase in the number of movable cages in the building, the changeover storey can be moved to more frequently and queues are thus avoided or limited in targeted manner. In addition, existing elevator installations can thus be modernized simply, quickly and favorably.

Other features and advantages of the present invention will become apparent from the following description of the invention which refers to the accompanying drawings.

BRIEF DESCRIPTION OF THE DRAWINGS

The invention is explained in detail in the following on the basis of several embodiments by way of example, wherein.

DETAILED DESCRIPTION OF THE INVENTION

Figure 1:
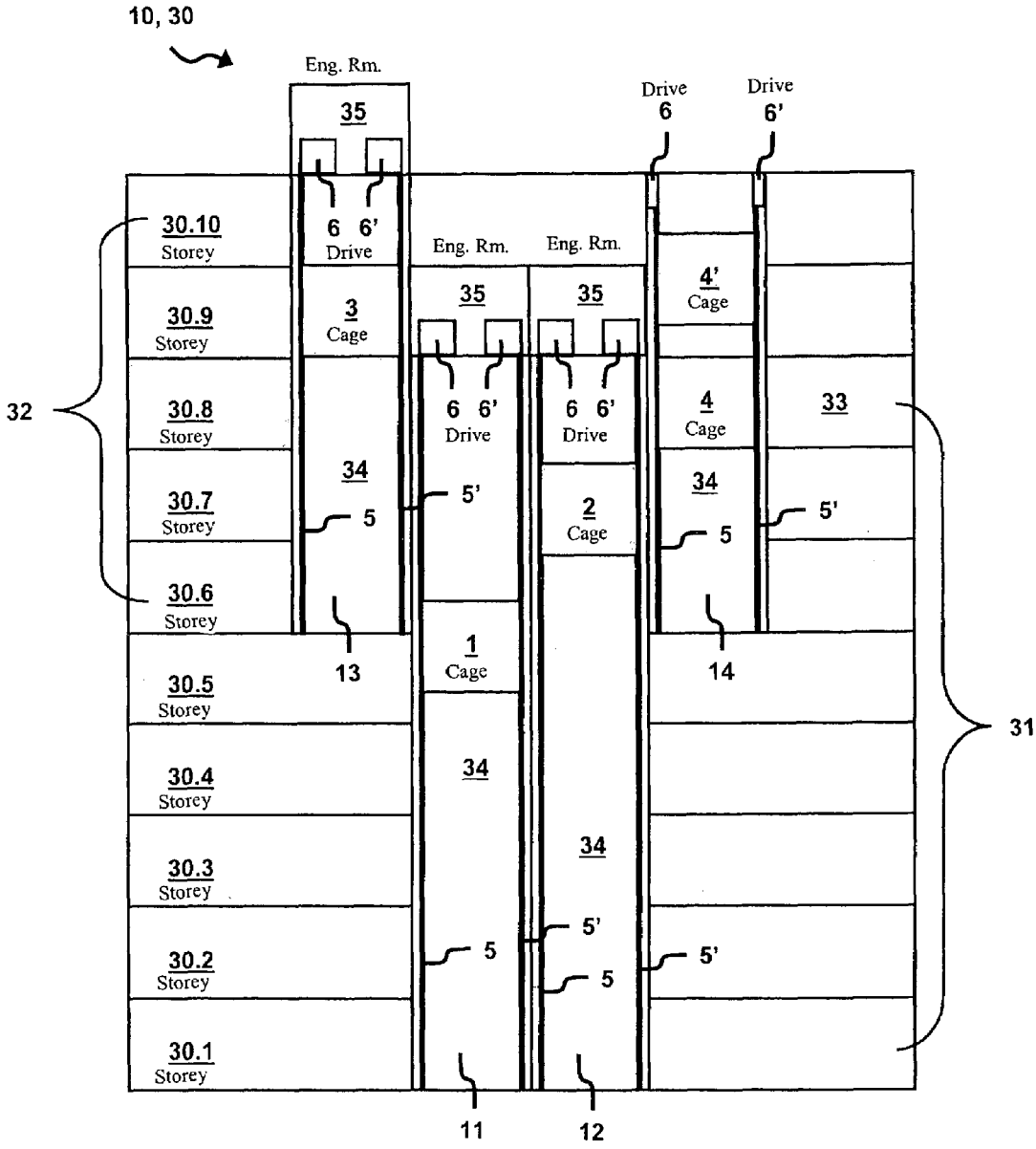
FIG. 1 shows a schematic illustration of a part of a first embodiment of an elevator installation for zonal operation in a building with two cages, which are movable independently of one another at a pair of guide rails, of an elevator departing.
Figure 2:
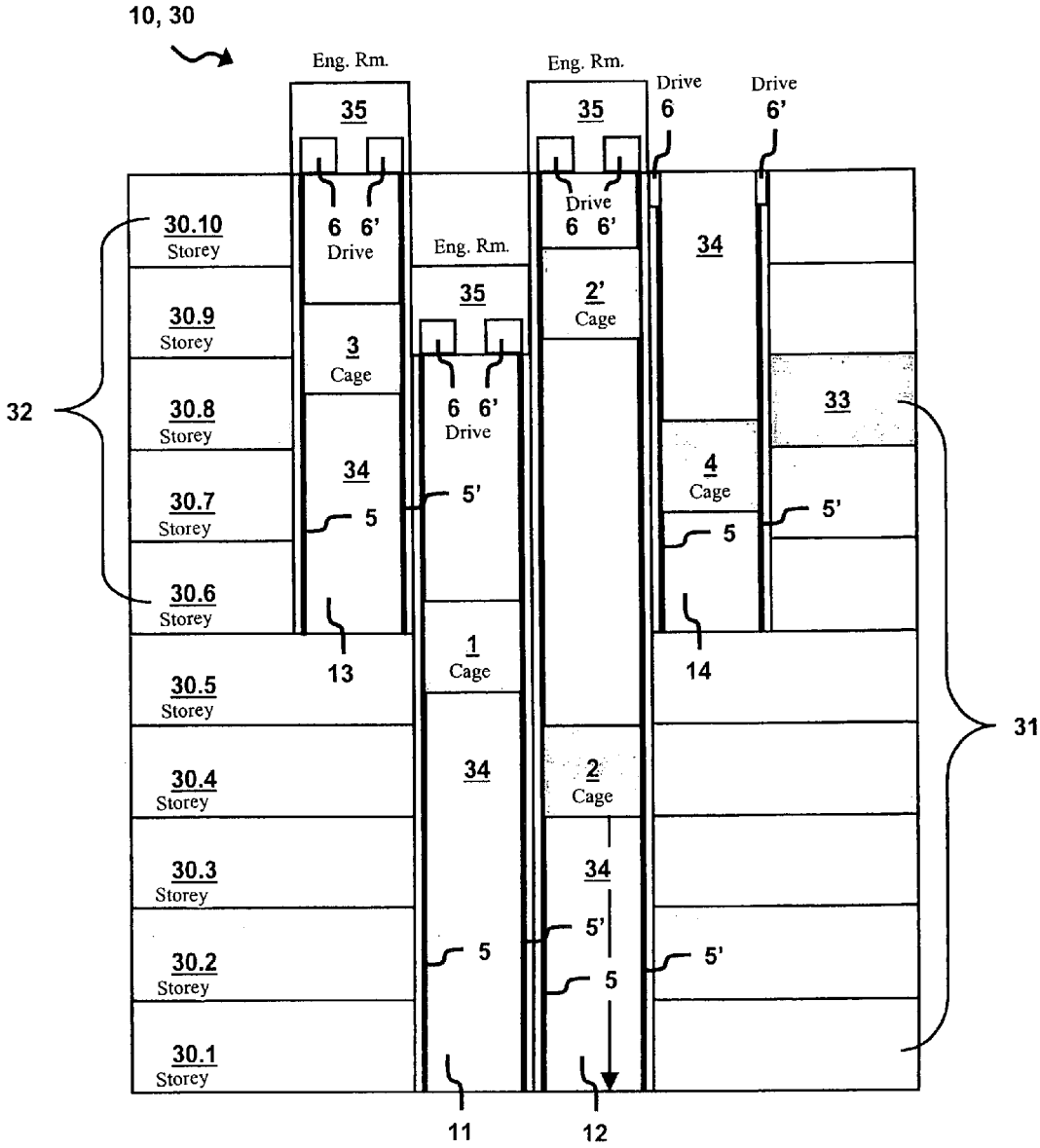
FIG. 2 shows a schematic illustration of a part of a second embodiment of an elevator installation for zonal operation in a building with two cages, which are movable independently of one another at a pair of guide rails, of an elevator for both taking to and taking away.
Figure 3:
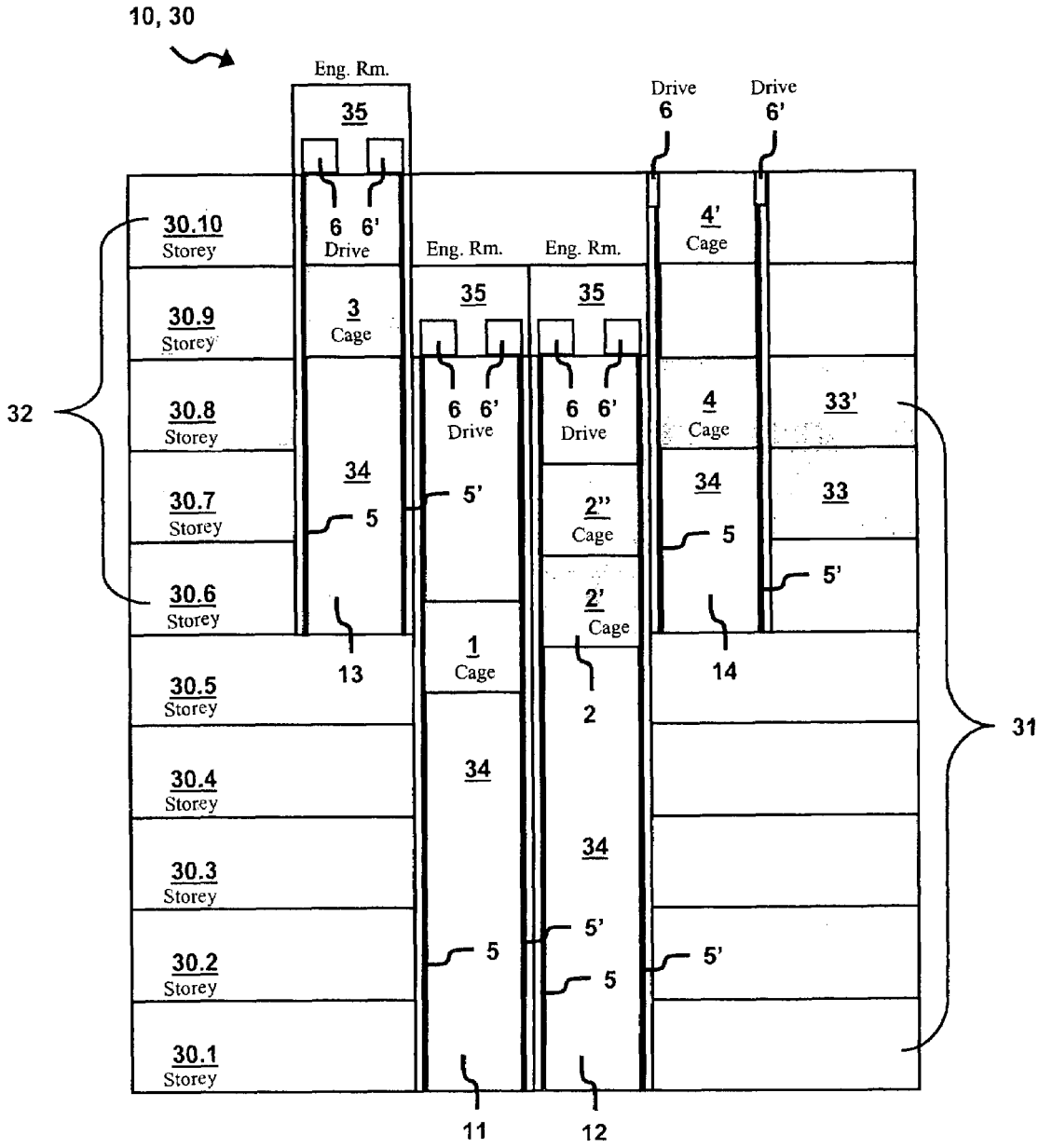
FIG. 3 shows a schematic illustration of a part of a third embodiment of an elevator installation for zonal operation in a building with a multi-cage of an elevator taking to and two cages, which are movable independently of one another at a pair of guide rails, of an elevator taking away.

Building: FIGS. 1 to 3 show different embodiments of an elevator installation 10 for conveying persons/goods between storeys 30.1 to 30.10 of a building 30. The building 30 is divided into several zones 31, 32. Each zone comprises several storeys. For example, a first zone 31 comprises the storeys 30.1 to 30.8 and a second zone 32 comprises the storeys 30.6 to 30.10. With knowledge of the present invention it is free to the expert to realize other zonal divisions with more than two zones and more or less storeys per zone.

Shafts: The elevator installation 10 comprises at least one elevator 11, 12, 13, 14, but advantageously several elevators 11, 12, 13, 14, which elevators 11, 12, 13, 14 are advantageously installed in shafts 34 of the building 30. Numerous possibilities of variation of the installation of the elevators 11, 12, 13, 14 in the building 30 are freely available to the expert. Thus, the shafts 34 can extend only partly through the building 30 or an elevator is installed without a shaft in an inner courtyard of the building 30 or outside the building 30.

Zones: The elevators 11, 12, 13, 14 transport persons/goods in the building 30. In that case the elevators 11, 12, 13, 14 are allocated to the zones 31, 32. Elevators 11, 12 of the first zone 31 are denoted as takers-to and elevators 13, 14 of the second zone 32 as takers-away. In the embodiments according to FIGS. 1 and 2 the storey 30.8 is a changeover storey 33, where a changing over of transported persons/goods between takers-to and takers-away is carried out. The embodiment according to FIG. 3 comprises two storeys 30.7, 30.8 as changeover storeys 33, 33'. The designations takers-to and takers-away is applicable as seen for a specific direction of the transport flow. In the following we consider takers-to and takers-away in the case of transport of persons/goods in upward direction in the building 30. These designations obviously reverse in the case of transport of persons/goods in downward direction in the building 30. Further details for zonal operation are described below in detail. With knowledge of the present invention it is free to the expert to employ a greater or lesser number of elevators for the zonal operation of the building. In addition, the expert can provide several changeover storeys one above the other. Finally, the expert can provide several takers-to, which are connected in series, with changeover storeys.

Cages: Each of the elevators 11, 12, 13 comprises at least one cage 1, 2, 3, 4, 4', which cages 1, 2, 3, 4' are moved as single cages or multi-cages in the vertical travel direction at a pair of guide rails 5, 5'. The cages 1, 2, 3, 4, 4' are conventional and proven elevator cages which are moved by way of the guide shoes at the guide rails 5, 5'.

Drives: The elevator installation 10 has a drive 6, 6' per cage 1, 2, 3, 4, 4'. The drives are, for example, drive pulley drives with drive pulleys which connect the cages 1, 2, 3, 4, 4' by way of conveying means with counterweights. For reasons of clarity the conveying means and counterweights are not illustrated in the figures. Advantageously each cage 1, 2, 3, 4' is connected by way of at least one conveying means with a counterweight, which conveying means are driven by drive pulleys by friction couple. The conveying means can have any desired form, and it can also be of any desired materials. For example, the conveying means can be a round cable, a double cable or a belt. For example, the conveying means can also be at least partly of steel or aramide fibers. With knowledge of the present invention the expert can use all known and proven drives 6, 6'. For example, gearless drives can be used or drives with gears. In addition, drives 6, 6' with permanent magnets, synchronous motors or asynchronous motors can be used. The drives 6, 6' can be arranged in separate engine rooms 35 or directly in the shaft 34. Here, too, the expert with knowledge of the present invention has free selection of the arrangement of the drives. For example, the drives 6, 6' can, as illustrated in the embodiment according to FIG. 1, be arranged at the upper end of guide rails 5, 5' at substantially the same height in the shaft 34.

Destination call control: Advantageously the elevator installation 10 transports persons/goods with a destination call control. In that case travel destinations are registered by way of a destination call input apparatus. In the case of the destination call control there is carried out not a prior cage call, but a destination call from a location of the building 30. For reasons of clarity, no destination call input apparatus are illustrated in the figures. The destination call input apparatus can be panels, for example with a decade keyboard, and/or touch-screens fixedly installed on the storeys 30.1 to 30.10 at the entrances to the elevator installation 10, but they can be mobile apparatus, such as mobile telephones, carried by the persons/goods. The destination call control obtains communication, by way of the destination call input apparatus, data about the location of the destination call input and the travel destination. These data can be used at any point in time of the zonal operation for optimization of the transport capacity of the elevator installation 10. Thus, the total number of elevators 11, 12, 13, 14 for transporting persons/goods can be ascertained from the data. In addition, the exact number of persons/goods changing over at the changeover storey 33, 33' is ascertained from the data. The destination call control controls all elevators 11, 12, 13, 14 in common and co-ordinated as a group. For that purpose the destination call control is connected by way of known and proven means with the drives 6, 6' and the cages 1, 2, 3, 4, 4'. Advantageously, the elevators 11, 12, 13, 14 are controlled in dependence on the number of persons/goods changing over in the changeover storey 33, 33', whereby an overfilling of the changeover storey 33, 33' is avoided or limited.

Advantageously the destination call control controls the elevators 11, 12, 13, 14 co-ordinated in such a manner that persons/goods are transported bunched. By bunched is understood a bunching in terms of time and location, i.e. persons/goods are transported at predetermined departure points in time by cages 1, 2, 3, 4, 4', which provide further transport in a further zone, and with consideration of the transport capacities of these cages 1, 2, 3, 4, 4', which provide further transport, to the changeover storey 33, 33'. Advantageously, the elevator 11, 12, 13, 14 for taking away waits with opened doors for the persons/goods changing over. The destination call control also makes it possible to communicate to every person, who is changing over, the elevator 11, 12, 13, 14 allocated to him or her as well as the cage 1, 2, 3, 4, 4' allocated to him or her, this also being able to be carried out before arrival at the changeover storey 33, 33'. With knowledge of the present invention the expert can, for example, employ indicating means which indicates to every person, who is changing over and who is located in front of entrances to the elevators 11, 12, 13, 14 and/or in a cage 1, 2, 3, 4, 4' taking to the changeover storey 33, 33' and/or located in the changeover storey 33, 33' itself, the elevator 11, 12, 13, 14 allocated to him or her as well as the cage 1, 2, 3, 4, 4' allocated to him or her. The indicating means can be arranged at different locations. They can be parts of panels arranged in stationary position in the cages 1, 2, 3, 4, 4' and/or in front of the entrances to the elevators 11, 12, 13, 14 and/or in the changeover storey 33, 33'. The display means can, however, also be parts of mobile apparatus, such as mobile telephones, carried by the persons. Such an indication can be, for example "Please take elevator B and wait at the second cage".

Statistical unit: The destination call control recognizes how many persons/goods have to change over in the changeover storey 33, 33' and advantageously comprises a statistical unit. The statistical unit obtains from the destination call control, even at the first destination call input of each person or item of goods changing over, a statement of the approximate arrival time at the changeover storey 33, 33'. As soon as the exact disembarkation time of the person/goods making the changeover in the changeover storey 33, 33' is known, this is communicated to the statistical unit together with the approximate boarding time in a cage 1, 2, 3, 4, 4' providing further transport. As soon as the exact arrival time of the cage 1, 2, 3, 4, 4' providing further transport is known, the destination call control reports this exact boarding time to the statistical unit. The statistical unit can thus record a future-oriented occupancy statistic for the changeover storey 33, 33', which is constantly refined by reports about the exact arrival and departure times per person/goods. In addition, an occupancy trend is detected by the statistical unit in that the positive or negative increase in the number of persons/goods in the changeover storey 33, 33' is ascertained per time interval. The statistic about the occupancy trend supplements the statement about the passenger number in the changeover storey 33, 33' in order to thus draw correct conclusions about the development of future occupancy of the occupancy storey 33, 33'.

In the statistical units, two parameters "maximum number of passengers in the changeover storey; switch on increased transport capacity" and "maximum number of passengers/goods in changeover storey; switch off increased transport capacity" are used. These two parameters are provided with threshold values individually per building 30 and changeover storey 33, 33' since they are dependent on the respective architectonic solution of the elevator foyers and on the possible non-uniformity of the transport capacities between cages 1, 2, 3, 4, 4' taking to and taking away. If the occupancy statistic recorded by the statistical unit has reached a threshold value for the parameter "maximum number of passengers in the changeover storey; switch on the increased transport capacity" and the instantaneous occupancy trend indicates a correspondingly positive increase, automatic destination call control parameters of the cages 1, 2, 3, 4, 4' taking away are so adapted by means of the destination call control that the maximum transport capacity of the cages 1, 2, 3, 4, 4' taking away is activated. This is also termed peak traffic mode of the elevator installation 10. The transport capacity of the cages 1, 2, 3, 4, 4' taking to is maintained and the building 30 is filled in optimum manner, but not overfilled. For example, cages 1, 2, 3, 4, 4' taking away are preferably sent to the changeover storey 33, 33' and/or the arrival time of the cages 1, 2, 3, 4, 4' taking away is adapted to the heavily filled cages 1, 2, 3, 4, 4' taking to.

If a threshold value for the parameter "maximum number of passengers/goods in the changeover storey; switch off increased transport capacity" is reached and the occupancy trend points downwardly, the elevator installation 10 is again operated in normal traffic mode in which passenger comfort is optimal with sufficient transport capacity.

First form of embodiment: In the first embodiment of an elevator installation according to FIG. 1, elevators 11, 12 each with a cage 1, 2, which is movable at a pair of guide rails 5, 5', as taker to the changeover storey 33 in the first zone 31 and an elevator 13 with a cage 33, which is movable at a pair of guide rails 5, 5', as well as an elevator 14 with two cages 4, 4' movable independently of one another at a pair of guide rails 5, 5' serve as taker away of the changeover storey 33 in the second zone 32. The elevators 11, 12 take to transport persons/goods in the first zone 31 between the storeys 30.1 to 30.8 and the elevators 13, 14 take away transport persons/goods in the second zone 32 between the storeys 30.6 to 30.10. The middle storeys 30.6 to 30.8 can thus be served by all elevators 11, 12, 13, 14. Often, however, the takers-to directly serve the changeover storey 33 in shuttle service and do not serve any storeys 30.6, 30.7 near this directly served changeover storey 33. Advantageously, the elevator 14 which takes away transports persons/goods in one and the same zone 32 by two cages 4, 4' movable independently of one another at a pair of guide rails 5, 5', wherein the lower cage 4 serves a lower region of the zone 32, i.e. the middle storeys 30.6 to 30.8, and the upper cage 4' serves an upper region of the second zone 32, i.e. the upper storeys 30.8 to 30.10. The lower cage 4 always remains below the upper cage 4'.

Persons/goods with a travel destination in the lower region of the second zone 32 are transported in cages 1, 2 of the elevators 11, 12, which take to, of the first zone 31 to the changeover storey 33 and thereupon are further transported in the lower cage 4 of the elevator 14, which takes away, with two cages 4, 4', which are movable independently of one another, in the lower region of the second zone 32. The lower region of the second zone 32 comprises the storeys 30.6 to 30.8. The upper region of the second zone 32 comprises the storeys 30.8 to 30.10. In analogous manner, persons/goods with a travel destination in the upper region of the second zone 32 are transported in cages 1, 2 of the elevators 11, 12, which take to, to the changeover storey 33 and thereupon further transported in the upper cage 4 of the elevator 14, which takes away, with two cages 4, 4', which are movable independently of one another, in the upper region of the second zone 32. Conversely, persons/goods with a travel destination in the first zone 31 are transported in cages 4, 4' of the elevator 14, which takes to, with two cages 4, 4', which are movable independently of one another, of the second zone 32 to the changeover storey 33 and thereupon further transported in cages 1, 2 of the elevators 11, 12, which take away, in the first zone 31.

Second embodiment: In the second embodiment of an elevator installation according to FIG. 2 two cages 2, 2', which are movable independently of one another at a pair of guide rails 5, 5', belong to an elevator 12 which, by a lower cage 2, serves as taker-to of the changeover storey 33 in the first zone and, by an upper cage 2', as taker-away of the changeover storey 33 in the second zone 32. Advantageously, persons/goods are transported in the first zone 31 by the lower cage 2 movable at the pair of guide rails 5, 5' and persons/goods are transported in the second zone 32 by the upper cage 2' movable independently of the lower cage 2 at the same pair of guide rails 5, 5'. In addition, an elevator 11 with a cage 1 movable at a pair of guide rails 5, 5' serves as taker-to of the changeover storey 33 in the first zone 31 and two elevators 13, 14 each with a respective cage 3, 4 movable at a pair of guide rails 5, 5' serve as taker-away of the changeover storey 33 in the second zone 32.

Persons/goods with a destination storey in a second zone 32 are transported by a lower cage 2 of the elevator 12 with two cages 2, 2', which are movable independently of one another, in a first zone 31 to the changeover storey 33 and thereupon further transported in an upper cage 2' of the same elevator 12 in the second zone 32. Conversely, persons/goods with a travel destination in a first zone 31 are transported by an upper cage 2' of the elevator cage 12 with two cages 2, 2', which are movable independently of one another in a second zone 32 to the changeover storey 33 and thereupon further transported in a lower cage 2 of the same elevator 12 in the first zone 31.

Third embodiment: In the third embodiment of an elevator installation according to FIG. 3, an elevator 12 with a multi-cage 2 serves as taker-to to two changeover storeys 33, 33' in the first zone 31 and an elevator 14 with two cages 4, 4', which are movable independently of one another at a pair of guide rails 5, 5', serves as taker-away of the changeover storeys 33, 33' in the second zone 32. In addition, an elevator 11 with a cage 1 movable at a pair of guide rails 5, 5' serves as taker-to of the changeover storeys 33, 33' in the first zone 31 and an elevator 13 with a cage 3 movable at a pair of guide rails 5, 5' serves as taker-away of the changeover storeys 33, 33' in the second zone 32.

Advantageously, the multi-cage 2 transports persons/goods by a first cage 2" and by a second cage 2'". The storey 30.7 forms a lower changeover storey 33 and is served by the first cage 2". The storey 30.8 forms an upper changeover storey 33' and is served by the second cage 2'". With knowledge of the present invention it is obviously entirely possible to serve the two changeover storeys 33, 33' successively by the first cage 2" and by the second cage 2'". In addition, the expert can employ more than one elevator with a multi-cage and the expert can also use a triple cage or a quadruple cage. Finally, the expert can also provide only one changeover storey per multi-cage or more than two changeover storeys per multi-cage.

Persons/goods with a travel destination in a lower region of a second zone 32 are transported in the first cage 2" of the multi-cage 2 of the first zone 31 to the lower changeover storey 33 and thereupon further transported in the lower cage 4 of the elevator 14 with two cages 4, 4', which are movable independently of one another, in the lower region of the second zone 32. In analogous manner, persons/goods with a travel destination in the upper region of the second zone 32 are transported in the second cage 2'" of the multi-cage 2 of the first zone 31 to the upper changeover storey 33' and thereupon further transported in the upper cage 4' of the elevator 14 with two cages 4, 4', which are movable independently of one another, in the upper region of the second zone 32. The lower region of the second zone 32 comprises the storeys 30.6 to 30.8. The upper region of the second zone 32 comprises the storeys 30.8 to 30.10. Conversely, persons/goods with a travel destination in the first zone 31 are transported in two cages 4, 4', which are movable independently of one another, of an elevator 14 of the second zone 32 to the changeover storeys 33, 33' and thereupon are further transported in the multi-cage 2 in the first zone 31.

With knowledge of the present invention it is free to the expert to realize combinations of the illustrated embodiments. For reasons of time and space, these are not explained here in more detail.

Modernization: With the zonal operation according to the invention the transport capacity of an existing elevator installation can be increased by installation of an elevator 12, 14 with at least two cages 2, 2', 4, 4' movable independently of one another at a pair of guide rails 5, 5'. For this purpose an existing elevator simply has to be replaced by an additional cage. For example, the two drives 6, 6', as illustrated in the embodiments according to FIGS. 1 and 3, are arranged at the upper end of the guide rails 5, 5' at substantially the same height in the shaft 34. It is obviously also possible to arrange two drives 6, 6', as illustrated in the embodiment according to FIG. 2, in the engine room 35.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. An elevator installation for zonal operation in a building divided into several zones, the elevator installation comprising: a plurality of elevators for transport of persons/goods in cages; a zone associated with each elevator; and at least one changeover storey arranged between the zones for changing over of persons/goods between cages of different zones, at least one of the elevators has at least two cages which are arranged above one another and are movable independently of one another along a pair of guide rails, at least one changeover storey being served by at least two of the at least two independent cages.

2. The elevator installation according to claim 1, wherein the elevators of a first zone are operative to transport persons/goods to the changeover storey each time by a cage movable along a pair of guide rails, and the elevator of a second zone is operative to transport persons/goods to the changeover storey by two cages movable independently of one another along a pair of guide rails.

3. The elevator installation according to claim 1, wherein a lower one of the at least two cages movable along a pair of guide rails is operative to transport persons/goods in a lower region of a zone and an upper one of the at least two cages movable independently of the lower cage along the same pair of guide rails is operative to transport persons/goods in an upper region of the zone.

4. The elevator installation according to claim 2, wherein the at least two cages in the second zone include a lower cage operative to transport persons/goods in a lower region of the second zone and an upper cage operative to transport persons/goods in an upper region of the second zone.

5. The elevator installation according to claim 1, wherein one of the elevators is operative to transport persons/goods in a first zone by a lower cage movable along a pair of guide rails and the one elevator transports persons/goods in a second zone by an upper cage movable independently of the lower cage along the same pair of guide rails.

6. The elevator installation according to claim 2, wherein at least one elevator of a first zone is operatively constructed to transport persons/goods to the changeover storey by a multi-cage movable along a pair of guide rails.

7. A method for zonal operation of an elevator installation in a building divided into several zones, which elevator installation comprises several elevators for transport of persons/goods in cages, a zone associated with each elevator and at least one changeover storey arranged between the zones for changing over of persons/goods between cages of different zones, the method comprising the step of independently moving at least two cages, which are arranged above one another, of an elevator along a pair of guide rails, at least one changeover storey being served by at least two of the at least two independent cages.

8. A method for zonal operation of an elevator installation in a building divided into several zones, which elevator installation comprises several elevators for transport of persons/goods in cages, a zone associated with each elevator and at least one changeover storey arranged between the zones for changing over of persons/goods between cages of different zones, the method comprising the step of independently moving at least two cages, which are arranged above one another, of an elevator along a pair of guide rails, further including registering destination calls by persons/goods and determining a number of persons/goods changing over in the changeover storey from the destination calls at every instant of the zonal operation.

9. The method according to claim 8, further including operating the elevator installation in a peak traffic mode when a threshold value of the number of persons/goods changing over in the changeover storey is exceeded.

10. The method according to claim 8, further including operating the elevator installation in a normal traffic mode when a threshold value of the number of persons/goods changing over in the changeover storey is fallen below.

11. The method according to claim 7, including transporting persons/goods changing over to the changeover storey at predetermined departure points in time by cages providing further transport in a further zone.

12. The method according to claim 11, wherein persons/goods with a travel destination in a lower region of a second zone are transported in cages of a first zone to the changeover storey and thereupon are further transported in a lower cage of the elevator by two cages, which are movable independently of one another, in the lower region of the second zone.

13. The method according to claim 11, wherein persons/goods with a travel destination in an upper region of a second zone are transported in cages of a first zone to the changeover storey and thereupon further transported in an upper cage of the elevator by two cages which are movable independently of one another in the upper region of the second zone.

14. The method according to claim 11, wherein persons/goods with a travel destination in a first zone are transported in two cages which are movable independently of one another of an elevator of a second zone to the changeover storey and thereupon are further transported in cages in the first zone.

15. The method according to claim 12, wherein persons/goods with a travel destination in an upper region of a second zone are transported in cages of a first zone to the changeover storey and thereupon further transported in an upper cage of the elevator by two cages which are movable independently of one another in the upper region of the second zone.

16. The method according to claim 12, wherein persons/goods with a travel destination in a first zone are transported in two cages which are movable independently of one another of an elevator of a second zone to the changeover storey and thereupon are further transported in cages in the first zone.

17. The method according to claim 13, wherein persons/goods with a travel destination in a first zone are transported in two cages which are movable independently of one another of an elevator of a second zone to the changeover storey and thereupon are further transported in cages in the first zone.

18. The method according to claim 12, wherein persons/goods with a travel destination in an upper region of a second zone are transported in cages of a first zone to the changeover storey and thereupon further transported in an upper cage of the elevator by two cages which are movable independently of one another in the upper region of the second zone and wherein persons/goods with a travel destination in a first zone are transported in two cages which are movable independently of one another of an elevator of a second zone to the changeover storey and thereupon are further transported in cages in the first zone.

19. The method according to claim 11, wherein persons/goods with a travel destination in a second zone are transported by a lower cage of the elevator with two cages, which are movable independently of one another, in a first zone to the changeover storey and thereupon are further transported in an upper cage of the same elevator in the second zone.

20. The method according to claim 11, wherein persons/goods with a travel destination in the first zone are transported by an upper change of the elevator with two cages which are movable independently of one another in a second zone to the changeover storey and thereupon further transported in a lower cage of the same elevator in the first zone.

21. The method according to claim 19, wherein persons/goods with a travel destination in the first zone are transported by an upper cage of the elevator with two cages which are movable independently of one another in a second zone to the changeover storey and thereupon further transported in a lower cage of the same elevator in the first zone.

22. The method according to claim 11, wherein persons/goods with a travel destination in a lower region of a second zone are transported in a first cage of a multi-cage of a first zone to the changeover storey and thereupon are further transported in a lower cage of the elevator with two cages, which are movable independently of one another, in the lower region of the second zone.

23. The method according to claim 11, wherein persons/goods with a travel destination in an upper region of a second zone are transported in a second cage of a multi-cage of a first zone to the changeover storey and thereupon are further transported in an upper cage of the elevator with two cages which are movable independently of one anther in the upper region of a second zone.

24. The method according to claim 11, wherein persons/goods with a travel destination in a first zone are transported in two cages which are movable independently of one another of an elevator in a second zone to the changeover storey and thereupon are further transported in a multi-cage in the first zone.

25. The method according to claim 22, wherein persons/goods with a travel destination in an upper region of a second zone are transported in a second cage of a multi-cage of a first zone to the changeover storey and thereupon are further transported in an upper cage of the elevator with two cages which are movable independently of one another in the upper region of a second zone.

26. The method according to claim 22, wherein persons/goods with a travel destination in a first zone are transported in two cages which are movable independently of one another of an elevator in a second zone to the changeover storey and thereupon are further transported in a multi-cage in the first zone.

27. The method according to claim 23, wherein persons/goods with a travel destination in a first zone are transported in two cages which are movable independently of one another of an elevator in a second zone to the changeover storey and thereupon are further transported in a multi-cage in the first zone.

28. The method according to claim 22, wherein persons/goods with a travel destination in an upper region of a second zone are transported in a second cage of a multi-cage of a fist zone to the changeover storey and thereupon are further transported in an upper cage of the elevator with two cages which are movable independently of one another in the upper region of a second zone and wherein persons/goods with a travel destination in a first zone are transported in two cages which are movable independently of one another of an elevator in a second zone to the changeover storey and thereupon are further transported in a multi-cage in the first zone.

29. The method according to claim 7, further including indicating to each person., who is changing over and who is located before entrances to the elevators and/or in a cage taking to the changeover storey and/or in the changeover storey, the elevator allocated to him or her as well as the cage allocated to him or her.

30. A method of modernizing an elevator installation in a building divided into several zones, which elevator installation comprises several elevators for the transport of persons/goods in cages, a zone associated with each elevator and at least one changeover storey for changing over of persons/goods between cages of different zones is arranged between the zones, the method comprising the step of installing at least one elevator with at least two cages, which are arranged above one another and which are movable independently of one another, at a pair of guide rails, at least one changeover storey being served by at least two of the at least two independent cages.

* * * * *